United States Patent [19]

Sorrell

[11] Patent Number: 4,598,343

[45] Date of Patent: Jul. 1, 1986

[54] U-LAMP LEG BRACE

[75] Inventor: Malcolm E. Sorrell, Norwalk, Conn.

[73] Assignee: Voltarc Tubes, Inc., Fairfield, Conn.

[21] Appl. No.: 678,737

[22] Filed: Dec. 6, 1984

[51] Int. Cl.[4] ..... F21S 5/00

[52] U.S. Cl. ..... 362/216; 362/396

[58] Field of Search ..... 362/216, 217, 382, 396

[56] References Cited

U.S. PATENT DOCUMENTS

| | | | |
|---|---|---|---|
| 2,652,483 | 9/1953 | Laidig et al. | 362/216 |
| 4,318,160 | 3/1982 | Dooley et al. | 362/216 |
| 4,422,010 | 12/1983 | Hammer | 362/216 |

FOREIGN PATENT DOCUMENTS

| | | | |
|---|---|---|---|
| 933526 | 9/1955 | Fed. Rep. of Germany | 362/216 |

*Primary Examiner*—Craig R. Feinberg

*Attorney, Agent, or Firm*—Parmelee, Bollinger & Bramblett

[57] ABSTRACT

A leg brace for a U-shaped fluorescent lamp is provided for supporting the legs to reduce destructive forces on the bend during shipment and installation. The brace comprises a support-spacer member having enclosed openings on opposite ends with the openings being spaced with the separation between the legs of the lamp. The diameter and shape of the openings provide a non-slipping friction fit for the lamp legs when the support-spacer member has the legs of the inserted therein, and which supports and maintains the leg separation by an amount corresponding with the leg alignment for insertion into a pair of electrical connecting sockets which receive mating electrical contacts on the ends of both legs. A U-shaped slot is located centrally between the holes for receipt of a support rod having a spring loaded hook assembly which may be used for holding the lamp and contacts in the sockets during use and to prevent the lamp from leaving the sockets in the mount. Recessed strengthening ribs are provided in the brace and are positioned between the holes. The brace is inserted on the legs of the lamp prior to shipment and stays on during shipment, handling and moving to the installation site and when being installed to prevent breakage of the bend of the U-shaped bulb due to movement of the legs during shipping and handling as well as during insertion of the legs into the mating sockets.

2 Claims, 5 Drawing Figures

Fig. 1.
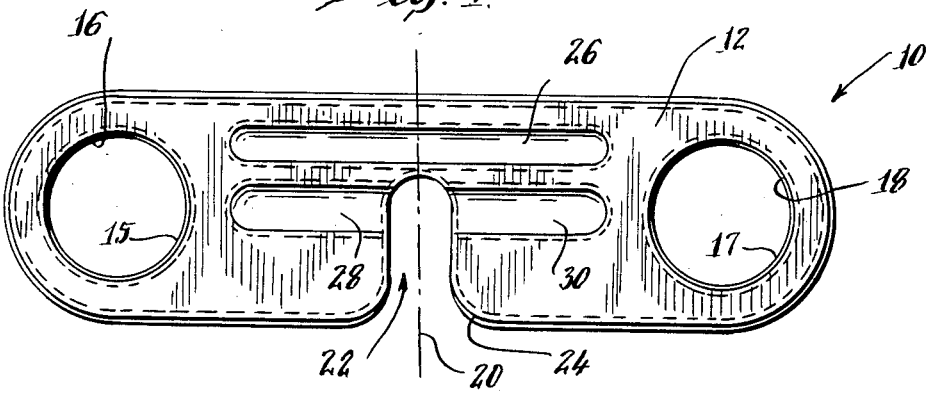
Fig. 2.
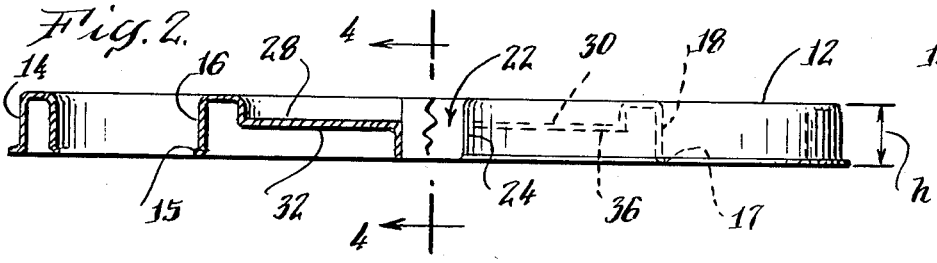
Fig. 3.
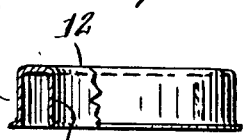
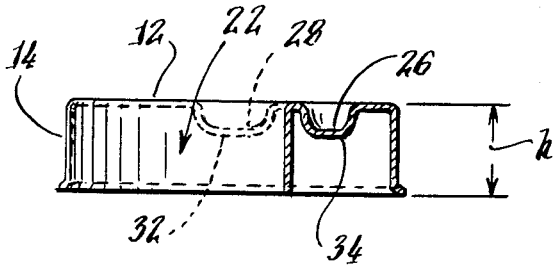
Fig. 4.
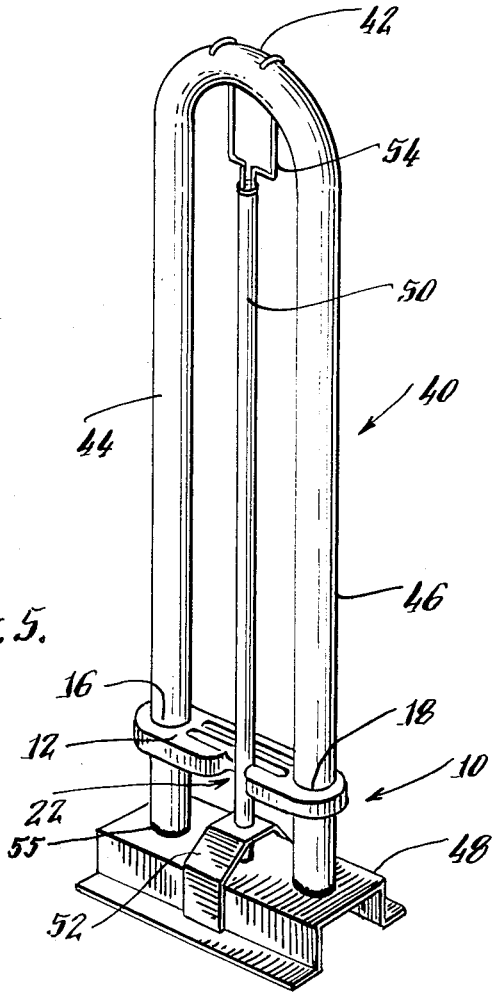
Fig. 5.

U-LAMP LEG BRACE

BACKGROUND OF THE INVENTION

This invention relates to U-shaped fluorescent lamps, and more particularly, to a leg brace which fits on the legs of such a lamp and which is used for supporting those legs during handling, shipment and installation of the lamps.

U-shaped fluorescent lamps are characterized by a 180° bend on one end with elongated generally parallel legs extending therefrom which terminate in bases with electrical contacts which plug into electrical connecting sockets mounted in a mount, but arranged on the same end as contrasted with two typical straight lamps which each have a pair of bases and a pair of sockets mounted on opposite ends. The U-shaped lamps have a number of applications but are particularly useful in the sign industry. In the case of a U-shaped lamp as contrasted with a straight lamp, one U-shaped lamp does the work of two short straight lamps which means fewer ballasts and sockets must be purchased and installed. U-shaped lamp ends are only inches apart in one raceway and are not separated by many feet, reducing wiring requirements. Since only a single ended lamp support is required, less raceway work is needed. Accordingly, for many applications fewer U-shaped lamps than straight lamps can be utilized for doing the same illumination job with savings of sign materials, ballasts, sockets, labor, and energy.

However, the U-shaped lamp with its 180° bend on one end with the legs extending therefrom has been generally more fragile because of the bend, and accordingly considered to be more difficult to handle than a single straight lamp. The problem has arisen in handling and shipment as well as in installation. Little leeway is tolerated in lateral movement of the legs, and the lamps are particularly vulnerable when being plugged into dual sockets in the mount, because undue pressure on one leg in entry to the socket may fracture the lamp bend. This is particularly true when the lateral movement of legs is toward each other putting the glass on the outside of the bend in tension. Since glass is weakened by tension, the thinned outside of the bend is most vulnerable when the legs are moved toward each other in handling, shipping, carrying to the fixture for installation or while installing.

SUMMARY OF THE INVENTION

Accordingly, it is an object of this invention to provide a new leg brace for a U-shaped lamp which supports such lamps during handling, shipment and installation.

A further object of this invention is to provide an improved leg brace for U-shaped fluorescent lamps which prevents breakage and can be installed before shipment and left on the lamp to facilitate and protect the lamp during handling, carrying and installation.

Still another object of this invention is to provide a new leg brace which holds the legs in alignment to facilitate their insertion into a dual socket mount.

A further object of this invention is to provide an improved leg brace for U-shaped fluorescent lamps which accommodates the mounting rod for lamps, which is part of a spring loaded hook and rod assembly adapted to hold the lamps in their sockets once they are installed.

In carrying out this invention in one illustrative embodiment thereof, the U-shaped lamp leg brace is provided for supporting the legs and bend of a U-shaped fluorescent lamp. The brace comprises a support-spacer member having enclosed openings on opposite ends thereof which openings are spaced in accordance with the separation between the legs of the U-shaped fluorescent lamp. The openings in the support-spacer member have diameters corresponding to the diameters of the legs of the U-shaped lamp whereby the legs are adapted to be inserted in the openings to provide a non-slip friction fit thereby supporting and separating as well as aligning the legs for handling, shipment, carrying and installation. The brace includes a U-shaped slot located centrally between the holes for accommodating the receipt of a support assembly rod employed to hold the U-shaped lamp in sockets once it is installed therein.

Accordingly, the U-shaped lamp leg brace is provided to support and align the legs, preventing movement therebetween during handling, shipment and carrying to the installation site as well as aligning the legs with the sockets in a mount into which the U-shaped lamps are to be inserted. Since the legs are aligned, the installer does not have to force the legs laterally while inserting the lamp into the sockets.

BRIEF DESCRIPTION OF THE DRAWINGS

FIG. 1 is a top plan view of the U-shaped lamp leg brace in accordance with the present invention.

FIG. 2 is a front side elevational view, partly in section, of the leg brace shown in FIG. 1.

FIG. 3 is an end view, partly in section, of the leg brace of FIG. 1.

FIG. 4 is a sectional view taken along line 4—4 of FIG. 2.

FIG. 5 is a perspective view of a U-shaped lamp mounted in a standard mount with the leg brace of the present invention positioned thereon.

DESCRIPTION OF THE PREFERRED EMBODIMENTS

Referring now to FIG. 1, a U-shaped lamp leg brace, referred to generally with the reference numeral 10, has an upper surface 12 with a downwardly extending skirt 14 thereby providing a depth dimension to the brace 10. A pair of walled holes 16 and 18 which are terminated in lips 15 and 17, respectively, are equally spaced on opposite sides of a center line 20 passing centrally through the leg brace 10. The spacing of the holes 16 and 18 will depend on the size of the lamps. Walled holes 16 and 18 having a depth dimension provide a cylindrical support surrounding each side and lips 15 and 17 are adapted to provide a non-slip friction fit for the lamp legs inserted therein. The equal spacing of the holes separate the legs of the lamp adapted to be inserted therein, and accordingly, hold them in non-slip alignment by predetermined distances determined by the equal spacing of the centers of the holes 16 and 18.

The leg brace 10 also includes a walled U-shaped slot 22 located centrally therein centered on the center axis 20 and having a flared mouth 24. The slot 22 is provided to accommodate a support rod as will be explained hereinafter.

The leg brace 10 is a support member, and accordingly is preferably made of a stiff plastic, for example, styrene plastic which may be white. The white color of the brace on the U-shaped lamps mounted therein increases the reflection and thereby reduces the shadow effect of the brace when the lamp is mounted.

As will best be seen in FIGS. 1, 2 and 4, grooves 26, 28 and 30, are molded into the top surface 12 of the leg brace 10 forming therein strengthening ribs 34, 32 and 36, respectively. If additional support is required or desired, the shorter ribs 32 and 36 may be formed with the complete inner walls instead of merging with the slot 22 as illustrated in FIGS. 1 and 2.

FIG. 5 illustrates the application and use of the leg brace 10 in a U-shaped lamp application. A typical U-shaped lamp, referred to generally with the numeral 40, includes a bend 42 and a pair of parallel legs 44 and 46 which terminate in standard bases 55. The lamp 40 is mounted on a standard mount 48 having sockets therein (not shown) to accommodate the standard bases 55 on the ends of the lamp legs 44 and 46. In a sign application, for example, the mount 48 including the sockets would be attached to the sign frame, and then be electrically wired. In some applications, a spring loaded hook 54 and rod 50 is mounted on the mount 48 through a bridge 52 and a hole in the mount 48 at one end thereof. The wire hook 54 spring loaded (not shown) in the rod 50 extends from the other end thereof.

The leg brace 10 is positioned on the legs 44 and 46 of the U-shaped lamp 40 after manufacture simply by inserting the legs 44 and 46 through the holes 16 and 18 of the leg brace 10 to provide a non-slip frictional fit. The leg brace 10 is actually shipped with the lamp and prevents lateral movement on the free ends of the legs 44 and 46 during shipment. In installation, the bases 55 at the ends of legs 44 and 46 are inserted in the sockets in the mount 48 with the aid of the leg brace 10 which actually positions both legs on centers corresponding to the centers of the sockets in which the legs are being mounted. Accordingly, the leg brace 10 aligns as well as supports the legs 44 and 46 as they are being inserted into the mount 48. The spring-loaded wire hook 54 of the rod 50 is pulled clear of the lamp end 42 and the hook 54 is released gently in order to hold the U-shaped fluorescent lamp 40 in place within the mount 48 and is adapted to retain the lamp 40 in that mount so that the lamp will not come out by vibration due to wind, shock or other forces on the sign. As will best be seen in FIG. 5, the U-shaped slot 22 with the flared opening 24 conveniently accommodates the spring-loaded rod 50 which is adapted to hold the lamp 40 in its mount once it is installed therein. The brace at the same time has been utilized to prevent breakage of the legs 44 and 46 during handling, shipment and moving the lamp to the sign where the lamp is to be installed. In addition to giving support during installation, the leg brace 40 properly spaces the legs 44 and 46 to enable proper alignment of the legs with the sockets in the mount 48 which allows easy insertion without permitting or requiring lateral force on either leg which could occur in the absence of providing such a leg brace.

Accordingly, a leg brace has been provided for a U-shaped fluorescent lamp which facilitates protecting and supporting the lamp once it has been fabricated, and the handling, packing and shipping as well as facilitating protecting the lamp during carrying the lamp to possibly precarious installation sites.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A U-shaped lamp leg brace for supporting a U-shaped fluorescent lamp of the type having a bend with separated legs of predetermined diameter extending in a same direction from said bend comprising:

a one-piece, non-metallic support spacer having enclosed openings on opposite ends thereof, said openings in said support spacer member being spaced in accordance with the separation between the legs of the U-shaped lamp, said openings in said support spacer member having diameters corresponding to the diameters of the legs of the U-shaped lamp whereby the legs of the U-shaped lamp are adapted to be inserted for a non-slip friction fit in said openings thereby supporting, separating and aligning the legs of the U-shaped lamp during handling, shipment, carrying and installation, and wherein the U-shaped lamp leg brace further having a U-shaped slot located centrally between said openings, said slot providing clearance for a separate support rod attached to an intermediate part of said U-shaped lamp which is employed to hold the U-shaped lamp in a socket.

2. The U-shaped lamp leg brace as claimed in claim 1 having recessed strengthening ribs therein postioned between said openings.

* * * * *